US005707056A

United States Patent [19]

Rauen et al.

[11] Patent Number: 5,707,056

[45] Date of Patent: Jan. 13, 1998

[54] VARIABLE RATIO FEEDHEAD PLENUM

[75] Inventors: David F. Rauen, Ontario; Mark Stevens, Henrietta, both of N.Y.

[73] Assignee: Xerox Corporation, Stamford, Conn.

[21] Appl. No.: 535,418

[22] Filed: Sep. 28, 1995

[51] Int. Cl.[6] ..... B65H 3/12

[52] U.S. Cl. ..... 271/96; 271/98; 271/108

[58] Field of Search ..... 271/96, 98, 108, 271/197; 407/78, 88, 86; 198/689.1

[56] References Cited

U.S. PATENT DOCUMENTS

| | | | |
|---|---|---|---|
| 4,712,784 | 12/1987 | Carrell | 271/108 |
| 4,887,805 | 12/1989 | Herbert et al. | 271/94 |
| 5,037,079 | 8/1991 | Siegel et al. | 271/3 |
| 5,344,133 | 9/1994 | Jantsch et al. | 271/98 X |
| 5,429,348 | 7/1995 | Martin | 271/96 |

*Primary Examiner*—David H. Bollinger
*Attorney, Agent, or Firm*—William A. Henry, II

[57] ABSTRACT

A vacuum corrugation feeder used to feed a wide variety of sheet sizes and stocks includes a variable ratio feedhead plenum. Included within vacuum plenum is an adjustable shutter apparatus that includes a foam roller mounted for rotation on shaft. A shutter member in the form of a plastic sheet is connected to the foam roller and can be wrapped and unwrapped around the foam roller by rotation of knob that is connected to the shaft depending on whether the vacuum pressure is to be high or low. The foam roller is mounted above a plenum plate of the vacuum plenum such that rotation of the knob in a clockwise direction causes the shutter to unwrap from the foam roller and partially cover vacuum holes in the plenum plate and thereby decrease the amount of negative pressure from the vacuum plenum that reaches sheets being fed. Manipulation of the knob in a counterclockwise direction removes the shutter from covering the holes in the plenum plate and thereby increasing the negative pressure to the sheet while simultaneously wrapping the shutter around the foam roller.

18 Claims, 4 Drawing Sheets

VARIABLE RATIO FEEDHEAD PLENUM

BACKGROUND OF THE INVENTION

This invention relates to an electrophotographic printing machine, and more particularly, concerns an improved vacuum corrugation feeder for such a machine.

Present high speed xerographic copy reproduction machines and printers produce copies at a rate in excess of several thousand copies per hour, therefore, the need for a sheet feeder to feed cut copy sheet to the machine in a rapid-dependable manner has been recognized to enable full utilization of the reproduction machine's potential copy output. In particular, for many purely duplication operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

PRIOR ART

A mechanism for shuttering of vacuum ports of a vacuum platen transport plenum in correspondence with the size of documents being transported from a document tray of a recirculating document handler is shown in U.S. Pat. No. 5,037,079.

One of the sheet feeders best known for high speed operation is the top vacuum corrugation feeder with a front air knife as disclosed in U.S. Pat. No. 4,887,805. In this system, a vacuum feedhead works in conjunction with an air knife to feed sheets from the tip of a stack. The feedhead is valveless and has a vacuum applied to it during the entire feed cycle in order to increase reliability and decrease minimum feed speed. The air knife includes trapezoidal shaped fluffer jets in front of the stack and side fluffer jets added on on the sides of the stack in order to assist the feedhead in separating severely downcurled sheets for feeding. However, because of the large variety of different paper sizes and stocks machines must handle in today's marketplace, it is still difficult for feeders of this type to feed long 17 inch and short 7 inch sheets equally well because the vacuum feedhead acquisition point of each sheet size is different.

SUMMARY OF THE INVENTION

Accordingly, disclosed herein is an improvement for a vacuum corrugation feeder that comprises an adjustable shutter which changes the acquisition point of a sheet being fed by the feedhead of the vacuum corrugation feeder to thereby prevent shingling between sheets and multifeeding. This feature enhances the marketability of a machine since a wide variety of sheet sizes can be accommodated while simultaneously minimizing multifeeding.

BRIEF DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE INVENTION

Figure 1:
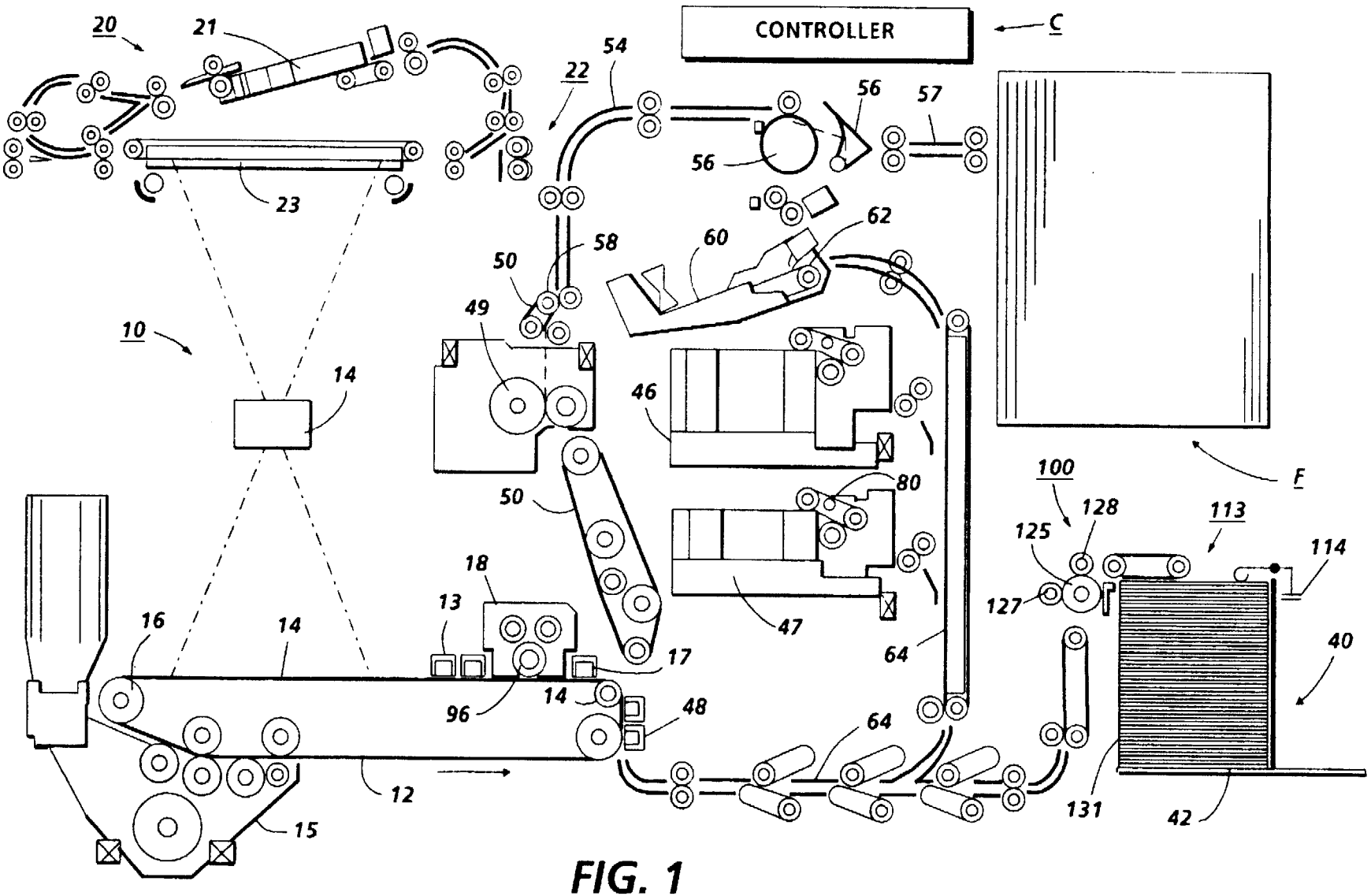
FIG. 1 is a schematic side view of an electrophotographic machine employing the improved copy sheet feeder of the present invention.

For a general understanding of the features of the present invention, reference is made to the drawings. In the drawings, like reference numerals have been used throughout to identify identical elements. FIG. 1 schematically depicts the various components of an illustrative electrophotographic printing machine with a sheet feeder incorporating the variable ratio feedhead plenum of the present invention therein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine 10 employs a photoconductive belt 12 and the xerographic stations acting thereon for respectively corona charging 13, image exposing 14, image developing 15, belt driving 16, precleaning discharge 17 and toner cleaning 18. Documents on the platen 23 may be imaged onto the photoreceptor 12 through a variable reduction ration optical imaging system to fit the document images to the selected size of copy sheets.

The control of all machine functions, including all sheet feeding, is conventionally, by the machine controller "C". The controller "C" is preferably a known programmable microprocessor, exemplified by the microprocessor disclosed in U.S. Pat. No. 4,166,558. The controller "C" conventionally controls all of the machine steps and functions described herein, and others, including the operation of the document feeder 20, all the document and copy sheet deflectors or gates, the sheet feeder drives, the finisher "F", etc. The copier controller also conventionally provides for storage and comparison of the counts of the copy sheets, the number of documents recirculated in a document set, the desired number of copy sheets and other selections and controls by the operator through the console or other panel of switches connected to the controller, etc. The controller is also programmed for time delays, jam correction control, etc. Conventional path sensors or switches may be utilized to help keep track of the position of the documents and the copy sheets and the moving components of the apparatus by connection to the controller. In addition, the controller variability regulates the various positions of the gates depending upon which mode of operation is selected.

The copier 10 is adapted to provide either duplex or simplex precollated copy sets from either duplex or simplex original documents presented by the RDH 20. Two separate copy sheet trays 46 and 47 and a multi-ream feeder apparatus 100 are provided for feeding clean copy sheets from either one selectably. They may be referred to as the main tray 46, auxiliary tray 47 and high capacity feeder 100.

The copy sheets are fed from the selected one of the trays 46, 47 or 100 to transfer station station 48 for the conventional transfer of the xerographic toner image of document images from the photoreceptor 12 to the first side of a copy sheet. The copy sheets are fed by a vacuum transport to a roll fuser 49 for the fusing of that toner image thereon. From the fuser, the copy sheets are fed through a sheet decurler 50. The copy sheets then turn a 90° corner path 54 in the sheet path which inverts the copy sheets into a last-printed face-up orientation before reaching a pivotal decision gate 56. The image side which has just been transferred and fused is face-up at this point. If this gate 56 is down it passes the sheets directly on without inversion into the output path 57 of the copier to the finisher module "F". If gate 56 is up it deflects the sheets into a duplex inverting transport 58. The inverting transport 58 inverts and then stacks copy sheets to be duplexed in a duplex buffer tray 60.

The duplex tray 60 provides intermediate or buffer storage for those copy sheets which have been printed on one side and on which it is desired to subsequently print an image or images on the opposite side thereof, i.e., copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path 664 as is provided for clean (blank) sheets from the trays 47, 47 or 100. It may been seen that this copy sheet feed path 64 between the duplex tray 60 and the transfer station 48 had an inherent inversion which inverts the copy sheets once. However, due to the inverting transport 58 having previously stacked these buffer sheets printed face-down in the duplex tray 60, they are represented to the photoreceptor 12 at the transfer station 48 in the proper orientation, i.e., with their blank or opposite sides facing the photoreceptor 12 to receive the second side image. This is referred to as the "second pass" for the buffer set copies being duplexed. The now fully duplexed copy sheets are then fed out again through the fuser 49 and fed out into the output path 57.

The output path 57 here transports the printed copy sheets directly, one at a time, into the connecting, on-line, modular, finishing station module "F". There the completed precollated copy sets may be finished by stapling, stitching, gluing, binding, and/or offset stacking.

Figure 2:
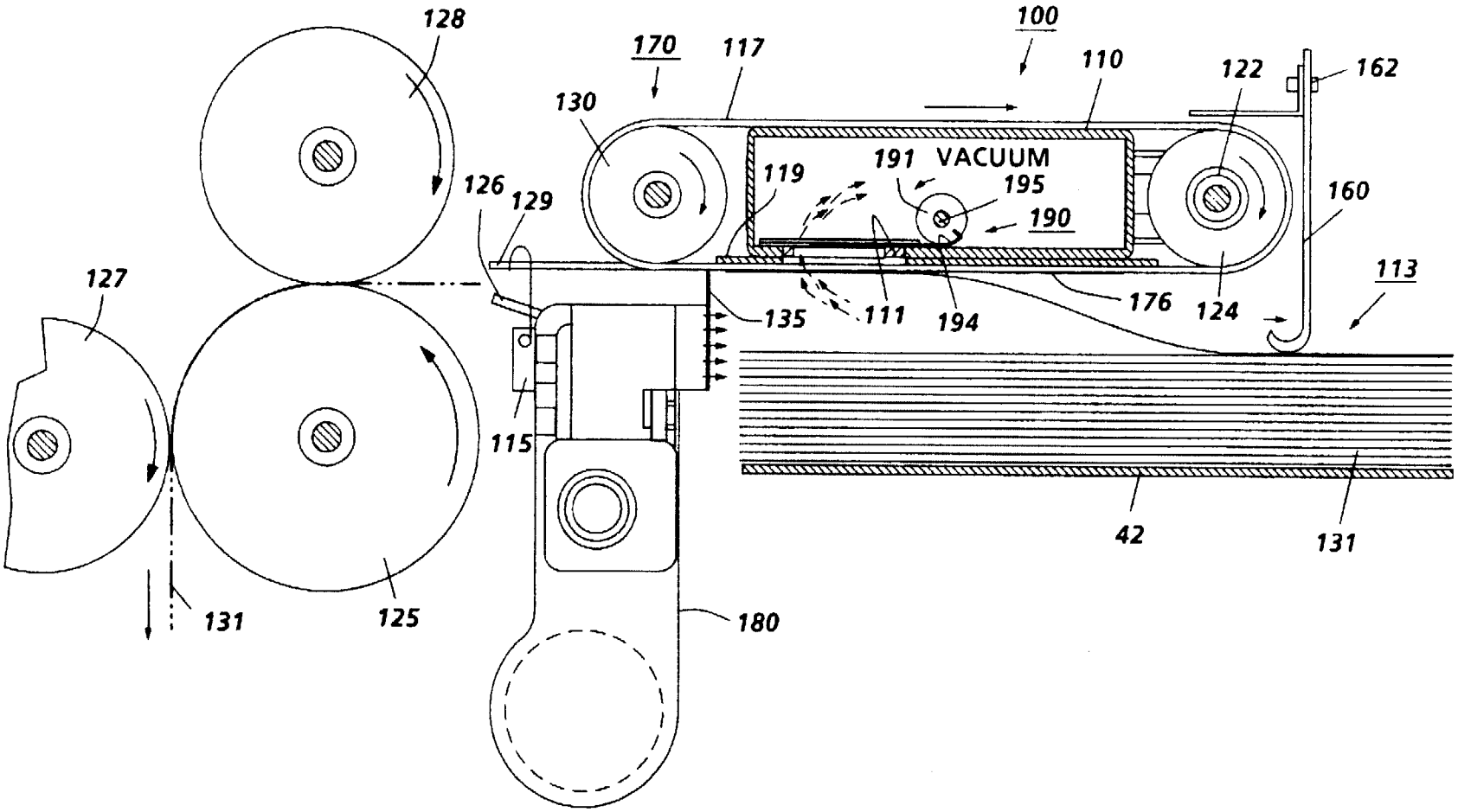
FIG. 2 is a schematic partial side view of the copy sheet feeder of the present invention.
Figure 3:
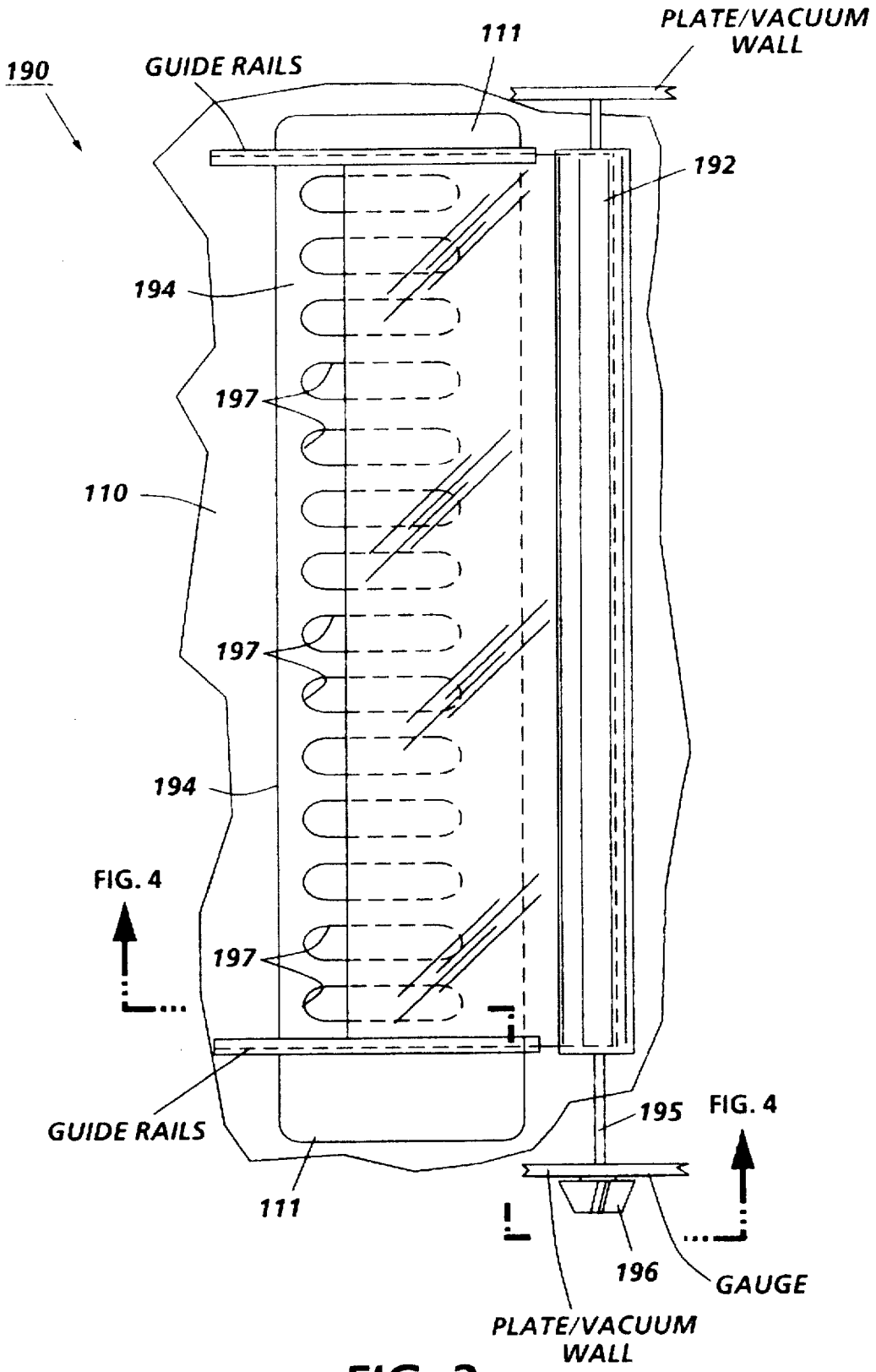
FIG. 3 is a schematic plan view showing the shutter mechanism of copy sheet feeder of FIG.2.
Figure 4:
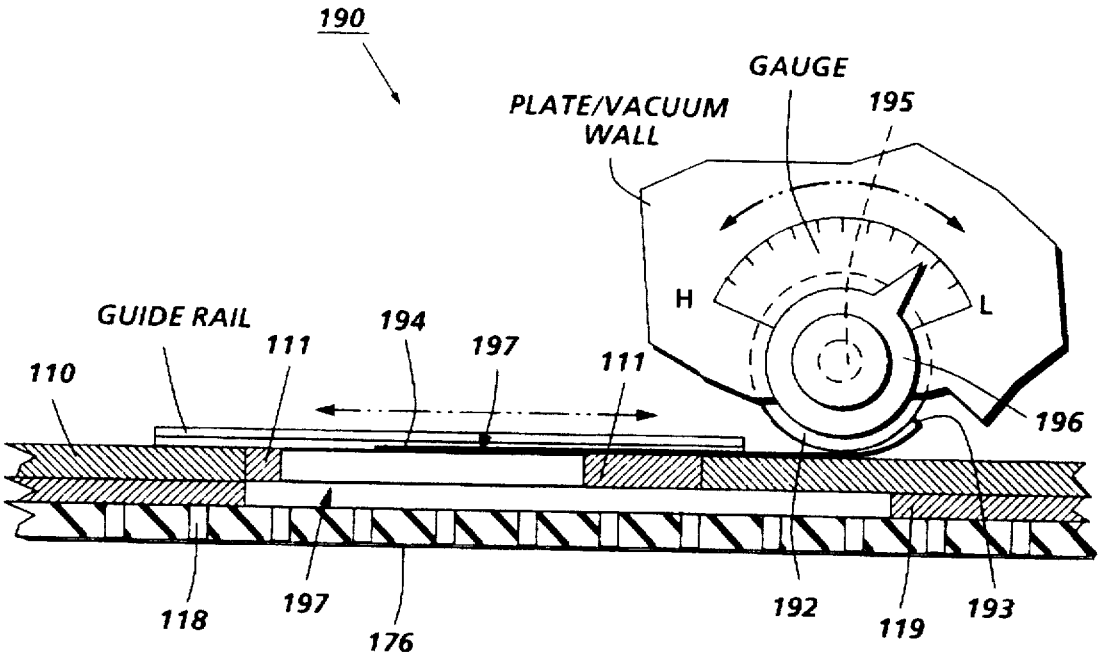
FIG. 4 is a schematic partial cross section of the shutter mechanism of FIG.3 taken along the section line FIG. 4—FIG. 4 in FIG. 3.

Referring now to a particular aspect of the present invention, FIGS. 2–4 show a high capacity copy sheet feeding system employing a vacuum feedhead that incorporates the variable ratio feedhead plenum in accordance with the present invention. Alternatively or in addition, the sheet feeder may be mounted for feeding document sheets to a platen of a printing machine. The sheet feeder 100 is provided with a conventional elevator mechanism (not shown) for raising and lowering either tray 40 or platform 42. Ordinarily, a drive motor is actuated to move the sheet stack support platform 42 vertically by a stack height sensor 114 positioned above the rear of the stack when the level of sheets relating to the sensor fall below a first predetermined level. The drive motor is deactuated by the stack height sensor when the level of the sheets relative to the sensor is above a predetermined level.

Vacuum corrugation feeder 100 that includes a vacuum plenum 110 is positioned over a portion of and beyond the front end of tray 40 having copy sheets 131 stacked therein. Vacuum plenum 110 has a grounded metal member 119 attached to a portion of its bottom surface that is adapted to dissipate static electricity. Belts 117 are entrained around drive roller 130 and idler roller 124, as well as, plenum 110. Belts 117 could be made into a single belt, if desired. Perforations 118 in the belts allow a suitable vacuum source (not shown) to apply a vacuum through plenum 110 and belts 117 to acquire sheets 131 from stack 113. The feeder uses a system of low inertia hardware, a take away jam switch 115, and a drag brake 122 to control the precise stopping position of the belts 117. Air knife 180 applies a positive pressure to the front, as well as, the sides of the sheet stack to separate the top sheet in the stack and enhance its acquisition by vacuum plenum 110. Corrugation rail 176 is attached or molded into the underside and center of plenum 110 and causes sheets acquired by the vacuum plenum to bend during their corrugation so that if a second sheet is still sticking to the sheet having been acquired by the vacuum plenum, the corrugation will cause the second sheet to detack and separate from the top sheet. A sheet captured on belts 117 is forwarded through baffles 126 and 129 into forwarding drive roller 125 and idler rollers 127 and 128 for transport to transfer station 48. In order to prevent multifeeding from tray 40, a pair of restriction members 133 and 135 are attached to the upper front end of air knife 180 and serve to inhibit all sheets other than sheet 1 from leaving the tray and is especially useful in inhibiting multifeeding of heavy weight sheets. It is also possible to place these restriction members of fangs on the tray instead of the air knife. Air knife 180 includes side fluffer jets (not shown) on one or both sides of the stack to enhance sheet separation.

Upon exiting air knife 180, the air is directed against the bottom of the feedhead of the vacuum corrugation feeder with a portion of the air being deflected by the feedhead toward and away from the stack of sheets in tray 40 with the portion of the air being deflected toward the stack serving to fluff the top sheets in the stack and separate sheet one from sheet two, etc. A damper member 160 which is rotatable about pivot member 162 controls air leakage from the stack sides, as well as, controls the level of instability when light weight paper is fed. Vacuum plenum 110 can be equipped with either a negative source that is ON continuously during the feed cycle, with the only criteria for sheet feeding being that the motion of vacuum feedhead 170 is ceased prior to the trail edge of the acquired sheet exposing all of the vacuum ports or the negative pressure source could be valved. However, if the negative pressure source is valved, the vacuum valve is turned OFF as soon as the feed sheet arrives at the take away roll and is then turned back ON when the trail edge of the feed sheet passes the lead edge of the stack.

Since vacuum corrugation feeder 100 is to be used with a wide variety of sheet sizes and stocks, a variable ratio feedhead plenum improvement is included within vacuum plenum 110 in the form of an adjustable shutter apparatus 190 that comprises foam roller 192 mounted for rotation on shaft 195 as shown in detail in FIGS. 3 and 4. A shutter member in the form of a plastic sheet 194 is connected to the foam roller at 193 and adapted to be wrapped and unwrapped around foam roller 192 by rotation of knob 196 that is connected to shaft 195 depending on whether the vacuum pressure is to be high or low. Foam roller 192 is mounted above plenum plate 111 of vacuum plenum 110 and adapted such that rotation of knob 196 in a clockwise direction causes shutter 194 to unwrap from foam roller 192 and partially cover vacuum holes 197 in plenum plate 111 and thereby decrease the the amount of negative pressure from the vacuum source that reaches sheets 131. Manipulation of knob 196 in a counterclockwise direction removes shutter 194 from covering holes 197 in plenum plate 111 while simultaneously wrapping the shutter around foam roller 192. This action increases negative pressure to sheets 131 since holes 197 are exposed proportionately to the degree of wrapping of shutter 194 around the foam roll.

The variable ratio feedhead plenum of the present invention allows for adjustable shutter 194 to change the acquisition point of the sheet being fed in order to make the feedhead more universal in feeding a wide variety of sheet sizes and stocks. By moving the sheet acquisition point farther or closer to the lead edge of the sheet, the point of acquisition of the next sheet is moved farther also. Thus, multifeeding and shingling of sheets is diminished. Through adjustment of knob 196, the operator of the machine can customize the feeder operation for non-standard and standard sizes of sheets as the arises.

As will be readily understood from the foregoing description, in the sheet feeding arrangement with a vacuum corrugation feedhead, according to the present invention, enhanced feeding of a wide variety of sheet sizes and stocks is attained by including an adjustable shutter in the vacuum plenum of the feedhead. The shutter is adapted to change the acquisition point of sheets by a vacuum plenum of the feedhead. Changing the acquisition point for each sheet stack size and stock reduces the possibility of sheet shingling and multifeeding.

The invention has been described in detail with particular reference to the preferred embodiment thereof, but it will be understood that reasonable variations and modifications are possible without departing from the spirit and basic scope of the invention.

We claim:

1. A sheet feeding apparatus for efficiently feeding a wide variety of sheet sizes and stocks, comprising: a sheet stack support tray for holding a stack of sheets for feeding to a predetermined location; a feedhead positioned in feed relationship to said sheet stack support tray and adapted to feed sheets from said sheet stack support tray in a predetermined direction, said feedhead including a vacuum plenum having holes therein positioned orthogonally with respect to said predetermined direction through which negative pressure is applied to draw a sheet thereto from the sheet stack; and an adjustable shutter positioned with respect to said holes in said vacuum plenum and adapted for movement in said predetermined direction to expose more or less of said holes in said vacuum plenum depending on the size and stock of the sheets being fed and thereby change lead edge acquisition points of different sheet sizes.

2. The sheet feeding apparatus of claim 1, including an air knife positioned immediately adjacent the front of the sheet stack in order to separate the one sheet in the stack from the rest of the sheets in the stack.

3. The sheet feeding apparatus of claim 1, wherein said shutter is mounted on a rotatable roll.

4. The sheet feeding apparatus of claim 3, wherein said roll is a foam roll.

5. The sheet feeding apparatus of claim 4, including a shaft on which said foam roll is mounted and a knob for manipulating said shaft.

6. The sheet feeding apparatus of claim 5, wherein said vacuum plenum includes a sheet corrugation means mounted in about the center of its bottom surface.

7. In a top sheet feeding apparatus having a sheet stack support tray, feedhead means for feeding sheets from the sheet stack support tray in a predetermined direction and including a vacuum plenum positioned over the front of a stack of sheets when sheets are placed in the tray with the vacuum plenum having a negative pressure applied thereto, the a vacuum plenum having holes therein positioned orthogonally with respect to said predetermined direction of sheet feeding and through which negative pressure is applied to draw a sheet thereto from the sheet stack, an improvement for enabling the sheet feeder to feed a wide variety of sheet sizes and stocks, comprising: an adjustable shutter positioned with respect to said holes in said vacuum plenum and adapted for movement in said predetermined sheet feeding direction to expose more or less of said holes in said vacuum plenum depending on the size and stock of the sheets being fed and thereby change lead edge acquisition points of different sheet sizes.

8. The top sheet feeding apparatus of claim 7, including an air knife positioned immediately adjacent the front of the sheet stack in order to separate the one sheet in the stack from the rest of the sheets in the stack.

9. The top sheet feeding apparatus of claim 7, wherein said shutter is mounted on a rotatable roll.

10. The top sheet feeding apparatus of claim 9, wherein said roll is a foam roll.

11. The top sheet feeding apparatus of claim 10, including a shaft on which said foam roll is mounted and a knob for manipulating said shaft.

12. The top sheet feeding apparatus of claim 11, wherein said vacuum plenum includes a sheet corrugation means mounted in about the center of its bottom surface.

13. A printing apparatus for printing page image information onto copy sheets, comprising: a photoconductor for receiving images representing page information; a copy sheet feeder for feeding copy sheets in a predetermined direction to receive the page image information; a transfer device for transferring the page image information from the photoreceptor to the copy sheets; a fuser for fusing the page image information to the copy sheets; and an output device for receiving the copy sheets with the page image information thereon; and wherein said copy sheet feeder includes a feedhead positioned in feeding relationship to said sheet stack support tray and adapted to feed sheets from said sheet stack support tray in said predetermined direction, said feedhead including a vacuum plenum having holes therein through which negative pressure is applied to draw a sheet thereto from the sheet stack; and an adjustable shutter positioned with respect to said holes in said vacuum plenum and adapted for movement in said predetermined direction to expose more or less of said holes in said vacuum plenum depending on the size and stock of the sheets being fed and thereby change lead edge acquisition points of different sheet sizes.

14. The sheet feeding apparatus of claim 13, including an air knife positioned immediately adjacent the front of the sheet stack in order to separate the one sheet in the stack from the rest of the sheets in the stack.

15. The sheet feeding apparatus of claim 13, wherein said shutter is mounted on a rotatable roll.

16. The sheet feeding apparatus of claim 15, wherein said roll is a foam roll.

17. The sheet feeding apparatus of claim 16, including a shaft on which said foam roll is mounted and a knob for manipulating said shaft.

18. The sheet feeding apparatus of claim 17, wherein said vacuum plenum includes a sheet corrugation means mounted in about the center of its bottom surface.

* * * * *